US010139208B2

(12) United States Patent
Andersson et al.

(10) Patent No.: US 10,139,208 B2
(45) Date of Patent: Nov. 27, 2018

(54) TRACER PROJECTILE AND METHOD FOR THE APPLICATION OF A TRACER DEVICE IN A TRACER PROJECTILE

(71) Applicant: NAMMO VANÄSVERKEN AB, Karlsborg (SE)

(72) Inventors: Åke Andersson, Mölltorp (SE); Andreas Bjärstätt, Karlsborg (SE); Henrik Johansson, Skövde (SE); Lina Norum, Skövde (SE)

(73) Assignee: NAMMO VANÄSVERKEN AB, Karlsborg (SE)

( * ) Notice: Subject to any disclaimer, the term of this patent is extended or adjusted under 35 U.S.C. 154(b) by 0 days.

(21) Appl. No.: 15/562,436

(22) PCT Filed: Mar. 29, 2016

(86) PCT No.: PCT/SE2016/000015
§ 371 (c)(1),
(2) Date: Sep. 28, 2017

(87) PCT Pub. No.: WO2016/159855
PCT Pub. Date: Oct. 6, 2016

(65) Prior Publication Data

US 2018/0087882 A1 Mar. 29, 2018

(30) Foreign Application Priority Data

Apr. 1, 2015 (SE) ..... 1530042

(51) Int. Cl.
*F42B 12/38* (2006.01)
*F42B 33/00* (2006.01)

(52) U.S. Cl.
CPC ..... *F42B 12/38* (2013.01); *F42B 33/001* (2013.01)

(58) Field of Classification Search
CPC ..... F42B 12/36; F42B 12/38; F42B 33/00; F42B 33/001
(Continued)

(56) References Cited

U.S. PATENT DOCUMENTS 2,530,934 A * 11/1950 Barton ..... F42B 12/38 102/513
3,898,933 A 8/1975 Castera et al.
(Continued)

FOREIGN PATENT DOCUMENTS

DE 8814176 U1 * 3/1990
DE 69017531 T2 * 8/1995
(Continued)

OTHER PUBLICATIONS

International Search Report (dated Jul. 7, 2016) for corresponding International App. PCT/SE2016/000015.

*Primary Examiner* — James S Bergin
(74) *Attorney, Agent, or Firm* — WRB-IP LLP

(57) ABSTRACT

A jacketed tracer projectile intended for small-caliber and medium-caliber weapons includes a metal core including a tracer device, in particular in the form of a pyrotechnic tracer charge, disposed inside a cavity in the metal core in the rear part of the projectile. The cavity is designed to prevent the tracer device from becoming separated from the cavity during the discharge phase of the tracer projectile. The cross-sectional area of the cavity is typically polygonal. A method for the application of the tracer device in the tracer projectile is also provided.

10 Claims, 2 Drawing Sheets

(58) Field of Classification Search
USPC ..... 102/439, 501, 513, 517
See application file for complete search history.

(56) References Cited

U.S. PATENT DOCUMENTS

| | | | | | |
|---|---|---|---|---|---|
| 5,760,329 | A * | 6/1998 | Baum | ..... | F42B 12/34<br>102/439 |
| 7,661,368 | B2 * | 2/2010 | Riess | ..... | F42B 12/38<br>102/501 |
| 8,007,608 | B1 * | 8/2011 | Herbage | ..... | C06B 27/00<br>149/108.2 |

FOREIGN PATENT DOCUMENTS

| | | | | | |
|---|---|---|---|---|---|
| DE | 29618454 | U1 * | 2/1998 | ..... | F42B 8/12 |
| DE | 29618454 | U1 | 2/1998 | | |
| DE | 10022004 | A1 | 11/2001 | | |
| EP | 0987513 | A2 * | 3/2000 | ..... | F42B 8/14 |
| EP | 0987513 | A2 | 3/2000 | | |
| GB | 392477 | A * | 5/1933 | ..... | F42B 12/38 |
| GB | 415674 | A * | 8/1934 | ..... | F42B 12/06 |
| GB | 1401376 | A * | 7/1975 | ..... | F42B 8/16 |
| GB | 1401376 | A | 7/1975 | | |
| GB | 1499784 | A * | 2/1978 | ..... | F42B 8/12 |
| GB | 1499784 | A | 2/1978 | | |

* cited by examiner

TRACER PROJECTILE AND METHOD FOR THE APPLICATION OF A TRACER DEVICE IN A TRACER PROJECTILE

BACKGROUND AND SUMMARY

The present invention relates to a jacketed tracer projectile with a metal core intended for small-caliber and medium-caliber weapons, comprising a tracer device disposed in the rear part of the projectile. The invention also relates to a method for the application of the tracer device in the projectile.

Jacketed tracer projectiles with a metal core intended for small-caliber ammunition in calibers up to and including 12.7×99 mm for rifles and submachine guns comprise a tracer charge normally disposed in the rear part of the projectile. The tracer charge is usually applied directly into a cavity intended for the purpose in the rear part of the projectile. Alternatively, the tracer charge is pre-installed in a so-called charge capsule, which is itself installed in the cavity by a shrinking or pressing process. A sealing wad/sealing disk is usually also disposed directly in connection with the tracer charge, the function of the sealing disk being to protect the jacket of the projectile from hot combustion gases, which are generated in conjunction with the combustion of the luminous charge. A sealing lacquer, which covers the open part of the tracer charge, is also included in certain cases, when moisture-sensitive pyrotechnic tracer charges are used, in order to protect against ambient moisture; see, for example, DE10022004 A1.

One problem associated with the aforementioned tracer projectiles concerns the attachment of the tracer charge in the projectile. Forces which act on the projectile during the discharge phase present the risk of the tracer charge becoming, separated, in whole or in part, from the projectile during the discharge phase. Examples of such influencing forces are the high pressures and temperatures acting on the projectile from behind caused by hot combustion gases from the tracer charge, uneven loading on the projectile caused by uneven combustion in the tracer charge in the radial direction, high compression pressures acting on the core of the projectile caused by high frictional forces between the rifling ribs of the barrel and the jacket of the projectile, and also high rotational forces on the projectile caused by the rifling ribs of the barrel during the acceleration phase of the projectile. Strong rotation of the projectile and the inertia of the tracer charge can lead to all or parts of the tracer charge becoming separated in the event of poor attachment of the tracer charge. Vibrations in the barrel of the weapon, so-called barrel-jump, can likewise lead to separations of the tracer charge. Barrel-jump is caused by vibrations in the barrel in the axial direction and/or in the radial direction, which vibrations are attributable to factors such as the rate of fire, the length of the barrel, the center of gravity and the strength.

A further problem associated with the aforementioned tracer projectiles is the number of parts that are used for the attachment of the luminous charge and for the protection of the jacket against combustion gases and against other external influences, such as moisture, which makes the tracer projectile complicated and expensive.

It is desirable to provide a tracer projectile intended for small-caliber and medium-caliber weapons comprising a tracer device, in particular a pyrotechnic tracer charge designed to reduce the risk of the tracer device, in whole or in part, becoming separated from its attachment in the projectile.

It is also desirable to provide a tracer projectile having few or no extra components for the attachment of the tracer device and for the protection of the jacket of the projectile.

Accordingly, what has been accomplished according to an aspect of the present invention is a jacketed tracer projectile with a metal core intended for small-caliber and medium-caliber weapons, comprising a tracer device disposed inside a cavity having a cross section S1,2 in the metal core in the rear part of the projectile, the cavity being designed for strong adhesion between the tracer device and the cavity.

The tracer projectile is characterized in that the cross section S1,2 of the cavity is polygon-shaped for strong adhesion to the interior walls of the cavity.

Further aspects of the tracer projectile according to preferred embodiments of the invention are indicated below:

According to one embodiment of the tracer projectile, the cross-sectional area S1 of the cavity is hexagon-shaped.

According to one embodiment of the tracer projectile, the cross-sectional area S2 of the cavity is star-shaped.

According to one embodiment of the tracer projectile, the tracer device is a pyrotechnic tracer charge.

According to one embodiment of the tracer projectile, the inner surface of the cavity has a surface roughness (Ra) in the range 0.2-3.2.

According to one embodiment of the tracer projectile, the cavity is cone-shaped in the axial direction, in the projectile, with a cone angle $\alpha$ in the range 0.2°-1.0°.

According to one embodiment of the tracer projectile, the metal core consists of steel.

Also accomplished according to an aspect of the present invention is a method for the application of a tracer device in a jacketed tracer projectile comprising a metal core.

The method is characterized by the following three steps:

1/ Machining of a cavity with a polygonal cross section S1 in the metal core, 2/ Machining of the interior walls of the cavity to a predetermined surface roughness (Ra) in the range 0.2-3.2, e.g. 0.5-1.5.

3/ Application of the tracer device in the cavity by a pressing process.

Further preferred embodiments of the method according to the invention are indicated below:

According to one embodiment of the method, the machining of the polygon-shaped cavity is performed in the metal core by a hot-forming method.

The invention, according to aspects thereof, entails a number of benefits and effects, of which the most important are:

The design of the cavity prevents the tracer device from becoming separated, in whole or in part, from its attachment as the projectile rotates strongly during the discharge phase.

The design of the cavity means that no extra components are required for the secure attachment of the tracer device.

The design of the cavity permits a simple and reliable manufacturing process of the projectile at low cost.

BRIEF DESCRIPTION OF THE DRAWINGS

Further benefits and effects of the invention will emerge from a perusal and consideration of the following detailed description of the invention with simultaneous reference to FIGS. 1-3 in the drawing, where.

DETAILED DESCRIPTION

Figure 1:
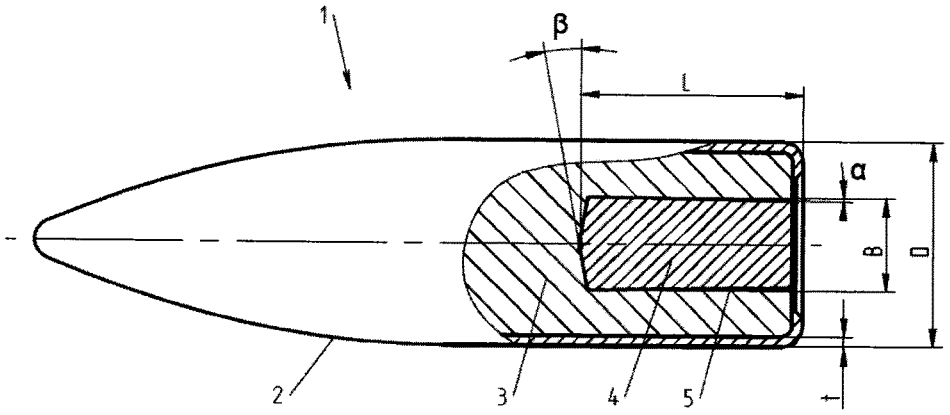
FIG. 1 depicts schematically a longitudinal section of a fully jacketed tracer projectile, comprising a metal core and a tracer device disposed inside a cavity in the rear part of the tracer projectile.

The tracer projectile 1 according to the invention is intended for small-caliber and medium-caliber weapons, in particular for calibers up to and including 12.7×99 mm. FIG. 1 depicts a longitudinal section of a fully jacketed tracer projectile 1 comprising a metal core 3 and a tracer device 4, in particular a pyrotechnic tracer charge, disposed in a cavity 5 in the rear part of the projectile 1.

The tracer projectile 1 also contains a ballast, which is not depicted here, disposed ahead of the tracer device 4, for example consisting of copper or lead. According to a preferred embodiment, the tracer projectile 1 is lead-free. According to a further embodiment, which is not depicted here, the projectile 1 is executed with transverse grooves in order thereby to achieve instability in the trajectory and thus a shortened trajectory, via the so-called Magnus effect.

The tracer projectile 1 according to FIG. 1 has the diameter D and is executed, in particular, with a pointed front part and a flat rear part. The tracer projectile 1 comprises a substantially all-enclosing jacket 2 having the jacket thickness t, a metal core 3 and a tracer device 4, in particular in the form of a pyrotechnic tracer charge disposed in the cavity 5 in the metal core 3 in the rear part of the projectile 1, the cavity, in particular, being elongated and having the length L.

In an alternative design, the projectile 1 is executed with a pointed rear part, a so-called boat-tail, which is not depicted here, for the purpose of achieving lower air resistance and thus a longer trajectory for the projectile 1.

The pyrotechnic tracer charge is of the so-called direct ignition type, with the result that the projectile 1 lights up directly from the moment at which the projectile 1 exits from the muzzle of the barrel of a weapon. The pyrotechnic tracer charge is of a conventional type and, as such, is not examined in more detail in the rest of the description.

Other types of tracer devices 4, such as laser-based or electrically based tracer sources, can also be used in alternative designs.

The jacket of the projectile 1 (see, for example, the jacket 2 in FIGS. 1-3) is, in particular, executed in steel. Alternatively, the jacket 1 can also include metals such as copper and/or zinc. The metal core 3 of the projectile 1 is, in particular, executed in a steel material.

According to a preferred embodiment, the cavity 5 of the projectile 1 is executed with a polygonal cross section S1,2. In one design, the cross-sectional area S1,2 is hexagon-shaped.

The cross-sectional area S1,2 can also be of other polygonal shapes, such as star-shaped. In one embodiment, the cavity 5 has the shape of a star-shaped six-point recess, corresponding to an internal hexagonal socket, also referred to as torx.

The surface roughness (Ra) of the cavity 5 should lie in the range 0.2-3.2, in particular in the range 0.5-1.5, for the best attachment/adhesion of the tracer device 4 in the cavity 5. Ra designates the arithmetical mean value of all deviations from a straight median line.

In order further to improve the adhesion of the tracer device 4 to the inner wall(s) of the cavity 5, the cavity 5 is weakly cone-shaped, in the axial direction in the projectile, with a cone angle $\alpha$ in the range 0-5°, in particular in the range 0.2-1.0°.

According to one embodiment, the front end wall of the cavity 5, nearest the front part of the projectile 1, is blunt or weakly cone-shaped in the direction towards the front part of the projectile 1 with a cone angle $\beta$ in the range 0-25°, e.g. 10-15°.

Figure 2:
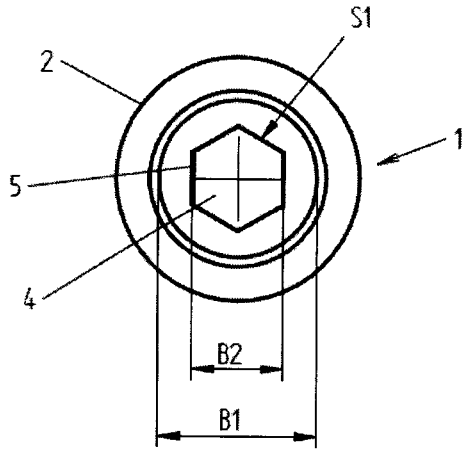
FIG. 2 depicts schematically a view from behind of a tracer projectile according to FIG. 1 having a hexagon-shaped cavity.
Figure 3:
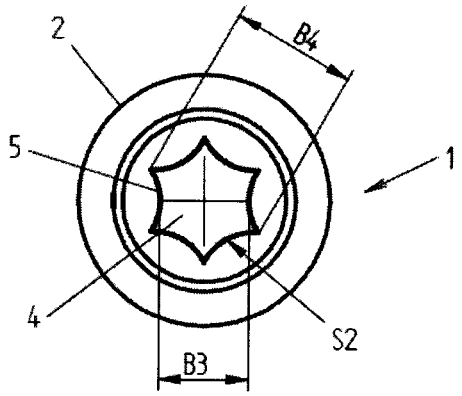
FIG. 3 depicts schematically a view from behind of a tracer projectile according to FIG. 1 having a star-shaped cavity.

It will be appreciated from FIG. 1 that the jacket 2 is folded over the flat rear part of the projectile 1 so that the jacket 2 thereby covers 10-25% of the flat rear part of the projectile 1. The jacket 2 is folded over the flat rear part, in particular, by a bending or shrinking process. FIGS. 2 and 3 depict the two alternative embodiments of the cavity 5 of the projectile 1. FIG. 2 depicts the first embodiment with a hexagon-shaped 5 cross-sectional area S1, the cross-sectional area S1 having a greatest width (B1) of 4.8 mm and a smallest width (B2) of 2.55 mm. FIG. 3 depicts the second embodiment with a star-shaped cross-sectional area S2, the cross-sectional area S2 having a greatest width (B3) of 5.8 mm and a smallest width (B4) of 1.55 mm.

The tracer device 4 is applied in the projectile 1 by a three-stage process comprising: 1/Machining a cavity 5 of polygonal shape directly in the metal core 3 in the rear part of the projectile 1, in particular, by a cold-forming method, alternatively by a hot-forming method or by laser machining. 2/ Machining the interior walls of the cavity 5 to a predetermined surface roughness (Ra) in the range 0.2-3.2 by a polishing process and/or a blasting process, and finally. 3/ Application of the tracer device 4 directly in the cavity 5, in particular by a pressing process.

Alternatively, the pyrotechnic tracer charge can be replaced by a tracer device 4 comprising one or more light-emitting diodes.

The invention is not restricted to the depicted embodiments, but can be varied in different ways within the scope of the patent claims.

The invention claimed is:

1. A tracer projectile intended for small-caliber and medium-caliber weapons, comprising
- a jacketed metal core comprising
  - a tracer device disposed inside a cavity in the metal core in a rear part of the projectile, and
  - a jacket that covers between 10-25% of the rear part of the projectile,
- wherein the cavity is polygon-shaped in cross-section for increased adhesion between the tracer device and the cavity.

2. The tracer projectile as claimed in claim 1, wherein the cross-sectional area of the cavity is hexagon-shaped.

3. The tracer projectile as claimed in claim 1, wherein the cross-sectional area of the cavity is star-shaped.

4. The tracer projectile as claimed in claim 1, wherein the cavity has a surface roughness (Ra) in the range 0.2-3.2.

5. The tracer projectile as claimed in claim 1, wherein the cavity is cone-shaped in an axial direction, in the projectile, with a cone angle $\alpha$ in the range 0.2°-1.0.

6. The tracer projectile as claimed in claim 1, wherein the tracer device is a pyrotechnic tracer charge.

7. The tracer projectile as claimed in claim 1, wherein the jacket consists of a mixture of copper and zinc.

8. The tracer projectile as claimed in claim 1, wherein the metal core consists of steel.

9. A method for the application of a tracer device in a tracer projectile having a metal core comprising a cavity, the method comprising:

machining a cavity with a polygonal cross section in a rear part of the metal core;

machining interior walls of the cavity to a predetermined surface roughness (Ra) in the range 0.2-3.2;

applying the tracer device in the polygon-shaped cavity by a pressing process; and covering between 10-25% of the rear part of the metal core with a jacket.

10. The method as claimed in claim 9, wherein machining of the cavity is performed by a hot-forming process.

* * * * *